US006573806B1

(12) United States Patent
Baur et al.

(10) Patent No.: US 6,573,806 B1
(45) Date of Patent: Jun. 3, 2003

(54) METHOD FOR ADJUSTING THE COUPLING FACTOR OF A STRIP LINE DIRECTIONAL COUPLER AND A STRIP LINE DIRECTIONAL COUPLER

(75) Inventors: Roland Baur, Villingen-Schwenningen (DE); Markus Laudin, Huefingen (DE); Christian Vollmer, Hinterzarten (DE)

(73) Assignee: IMS Connector Systems GmbH, Loffingen (DE)

( * ) Notice: Subject to any disclaimer, the term of this patent is extended or adjusted under 35 U.S.C. 154(b) by 0 days.

(21) Appl. No.: 09/572,772

(22) Filed: May 17, 2000

(30) Foreign Application Priority Data

May 19, 1999 (DE) ..... 199 22 831

(51) Int. Cl.[7] ..... H01P 3/08
(52) U.S. Cl. ..... 333/116; 333/205
(58) Field of Search ..... 333/116, 205, 333/238, 17.1

(56) References Cited

U.S. PATENT DOCUMENTS

| | | | | | |
|---|---|---|---|---|---|
| 2,934,719 | A | * | 4/1960 | Kyhl | 333/115 |
| 3,478,281 | A | * | 11/1969 | Jeong | 333/116 |
| 3,742,392 | A | * | 6/1973 | Schwarzmann | 333/128 |
| 3,768,042 | A | * | 10/1973 | Friend et al. | 333/116 |
| 3,886,498 | A | | 5/1975 | Mosko et al. | 333/128 |
| 5,012,209 | A | * | 4/1991 | Lantagne et al. | 333/116 |
| 5,079,759 | A | | 1/1992 | Kajiyama | 370/245 |
| 5,227,730 | A | * | 7/1993 | Kin et al. | 324/632 |
| 5,410,179 | A | * | 4/1995 | Kornrumpf et al. | 257/638 |
| 6,097,271 | A | * | 8/2000 | Kozakoff | 333/204 |

FOREIGN PATENT DOCUMENTS

| | | |
|---|---|---|
| EP | 0725522 A2 | 2/1996 |
| EP | 0883264 A1 | 5/1998 |
| GB | 2284095 A | 5/1995 |
| JP | 05121925 | 5/1993 |
| JP | 08154009 | 11/1996 |
| JP | 10190321 | 7/1998 |

OTHER PUBLICATIONS

L. Accatino, "Computer–Aided Tuning of Microwave Filters", Jul. 2, 1986, IEEE MTT–S Digest, p. 250.*

* cited by examiner

*Primary Examiner*—Robert Pascal
*Assistant Examiner*—Joseph Chang
(74) *Attorney, Agent, or Firm*—Samuels, Gauthier & Stevens, LLP

(57) ABSTRACT

A strip line directional coupler includes a controlled amount of potting compound applied to establish a desired coupling factor between at least two cooperating strip lines. In one embodiment the strip line directional coupler is positioned in a housing that is filled with the potting compound until the desired coupling factor is established. A network analyzer monitors the coupling factor as the potting compound is added. Once the desired coupling factor is established, the flow of potting compound into the housing is automatically terminated.

14 Claims, 1 Drawing Sheet

METHOD FOR ADJUSTING THE COUPLING FACTOR OF A STRIP LINE DIRECTIONAL COUPLER AND A STRIP LINE DIRECTIONAL COUPLER

BACKGROUND OF THE INVENTION

The invention relates generally to the field of strip line directional couplers, and in particular to a technique for adjusting the coupling factor of a strip line coupler with at least two strip lines disposed on a circuit board.

Strip line couplers are typically constructed of several strip lines, which for example are arranged opposite one another on a circuit board. For example, the strip lines can be strip conductors applied to the circuit board by printed circuit technology.

Strip line couplers are used to transfer HF signals from one strip to another by coupling. Consequently, they are used in multiple branch circuits for HF signals (e.g., in community antenna systems to distribute the signals received to several users). To assure a perfect signal line and coupling, a precisely defined coupling factor must meet prescribed tolerances. However, this can be achieved only with difficulty, because the thickness of the circuit board and the dimensions (e.g., the thickness, width and spacings) of the copper conductor strips vary considerably. Consequently, the coupling factors vary greatly and as a result a relatively large number of strip line couplers are often discarded during production as rejects.

Therefore, there is a need for a technique for precisely adjusting the coupling factor of strip line couplers.

SUMMARY OF THE INVENTION

Briefly, according to the present invention, a strip line directional coupler includes a controlled amount of potting compound applied to establish a desired coupling factor between at least two cooperating strip lines.

In one embodiment the strip line directional coupler is positioned in a housing that is filled with the potting compound until the desired coupling factor is established. A network analyzer monitors the coupling factor as the potting compound is added. Once the desired coupling factor is established, the flow of potting compound into the housing is automatically terminated.

Potting compound changes the electrical properties of the strip line coupler, and the invention uses this to change the electrical properties of the strip line coupler in a specific way.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
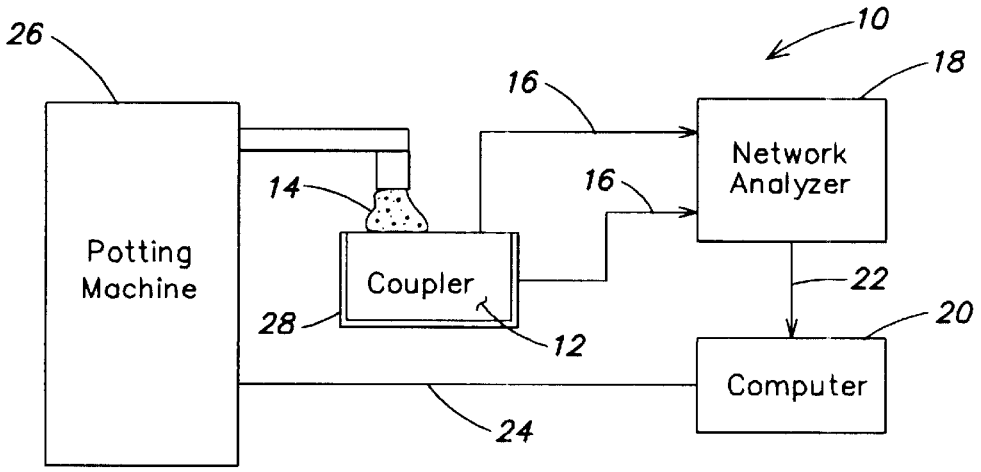
FIG. 1 illustrates an apparatus for implementing the inventive method.

FIG. 1 illustrates a system 10 for applying a prescribed amount of potting compound to cooperating strip lines to establish a desired coupling factor between the cooperating strip lines. A strip line coupler 12, which is to be potted with a potting compound 14, provides measurement lines 16 to a network analyzer 18 that is connected to a control unit 20 via a data line 22. The control unit 20 provides control line signal 24 that controls an apparatus 26 for potting the strip line coupler 12.

In order to measure the coupling factor, the network analyzer 18 sends test signals over the measurement lines 16 to the strip line coupler 12, which is seated in a housing 28. The control unit 20 controls the apparatus 26 for potting, for example a potting machine, so that the potting compound 14 is poured into the housing 28 in which the strip line coupler 12 is seated until the network analyzer 18 measures the prescribed coupling factor. In a certain sense, the strip line coupler 12 is equalized through the height H of the encapsulation.

This technique is used preferably for the production of strip line couplers. The strip line couplers 12 that are to be potted with the potting compound 14 are automatically connected via the measurement line 16 to the network analyzer 18. Under the control of the control unit 20, the potting machine 26 pours potting compound 14 into the housing 28 until the required coupling factor is achieved. The potted strip line coupler is then disconnected from the measurement line 16 so that the next one can be connected.

By programming the control unit 20 for different coupling factors, every strip line coupler can automatically be adjusted to a different coupling factor. Production can be converted very quickly to other coupling factors, and can be adapted at any time to the specific requirements of the customer.

A first advantage of the inventive method is that the strip line conductors are potted with the potting compound on the assembly line, and that the coupling factor is tested by the network analyzer. A second advantage is that preliminary testing of the circuit boards with the strip lines disposed thereon is obviated, because the strip line couplers are adjusted automatically. A third advantage is that the required coupling factor is adhered to very precisely. Rejection of unusable strip line couplers is consequently is significantly reduced.

Figure 2:
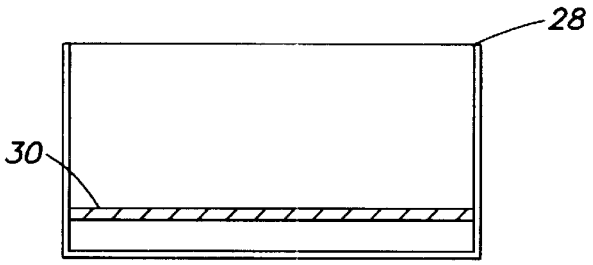
FIG. 2 illustrates a strip line conductor before potting.

The inventive strip line coupler will now be described and explained with reference to FIGS. 2 and 3. FIG. 2 illustrates a strip line coupler prior to the addition of a potting compound. The circuit board 30 on which the strip line is disposed is seated in the housing 28 that is open on top so as to be potted with the potting compound.

Figure 3:
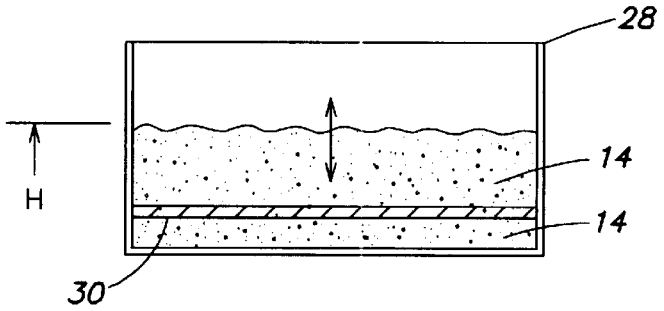
FIG. 3 illustrates an inventive strip line coupler after potting.

FIG. 3 illustrates a strip line coupler potted with the potting compound 14. The housing 28 is filled with the potting compound 14 up to a potting height H. The potting compound 14 may be situated only above the circuit board 30 or also below the circuit board 30. After being potted with the potting compound 14, the housing 28 is closed.

The inventive strip line coupler has a number of advantages. The potting compound protects the components on the circuit board against corrosion by corrosive gases or liquids. The electrical properties of the strip line coupler consequently remain preserved for a long time, even under unfavorable ambient conditions (e.g., on antenna masts in the open). Furthermore, the potting compound protects the components against mechanical shock (e.g., mechanical jolts or vibrations). This increased protection against shock is especially advantageous for SMD components, which are very sensitive to shocks. When being transported, the inventive strip line couplers are already sufficiently protected against shocks without additional measures. Consequently, they can also be used in vehicles where they are exposed to severe mechanical stresses from shocks or vibrations (e.g., in a helicopter).

In addition, the potting compound advantageously causes the heat generated in the components on the circuit board to be dissipated better. As a result, smaller components can be used, which reduces costs and is more beneficial from the point of view of HF technology.

The potting compound can be transparent or opaque. If the potting compound is transparent, damaged components on the circuit can easily be recognized. On the other hand, an opaque potting compound provides a certain protection against copying, because the structure of the circuit board is not visible. Regardless of the transparency of the potting compound, there is protection against copying since the circuit arrangement functions optimally only in conjunction with the potting compound. If the circuit arrangement is copied without a potting compound, it will not function properly since the coupling factor is not adjusted to the prescribed value, due to the absence of the potting compound.

An especially suitable potting compound is casting resin, to which for example a heat-conducting component can be affixed to improve thermal conductivity.

Although the present invention has been shown and described with respect to several preferred embodiments thereof, various changes, omissions and additions to the form and detail thereof, may be made therein, without departing from the spirit and scope of the invention.

What is claimed is:

1. A method for achieving a prescribed coupling factor of a strip line coupler, the strip line coupler having at least two strip lines disposed on a circuit board, the method comprising:

applying a potting compound to the strip lines; and automatically controlling the amount of potting compound applied during said applying step to achieve the prescribed coupling factor.

2. The method of claim 1 wherein the circuit board is disposed in a housing and said applying comprises filling the housing with the potting compound.

3. The method of claim 1, wherein said step of applying includes filling a housing that contains the strip line coupler with the potting compound.

4. The method of claim 3 wherein the potting compound is provided above and below the strip line coupler by said step of applying.

5. The method of claim 1 wherein the potting compound comprises a heat-conducting component.

6. The method of claim 1 wherein the potting compound is transparent.

7. The method of claim 1 wherein the potting compound is opaque.

8. The method of claim 1 wherein the potting compound is disposed adjacent to and below the strip line coupler, and adjacent to and above the strip line coupler.

9. A method for achieving a prescribed coupling factor of a strip line coupler, the strip line coupler having at least two strip lines disposed on a circuit board, the circuit board seated within a housing, the method comprising:

filling the housing with potting compound distributed from an apparatus for potting;

measuring coupling factors of the strip line coupler with a network analyzer, the network analyzer in communication with a control unit, the control unit in communication with the potting apparatus;

arresting the distribution of the potting compound in said filling step when the prescribed coupling factor is achieved, said arresting step comprising programming the control unit to recognize the prescribed coupling factor when measured and communicated from the network analyzer and to command the apparatus for potting to arrest the distribution of the potting compound upon receipt of the communication from the network analyzer.

10. The method of claim 9 wherein the potting compound is provided above and below the strip line coupler by said step of filling.

11. The method of claim 9 wherein the potting compound comprises a heat-conducting component.

12. The method of claim 9 wherein the potting compound is transparent.

13. The method of claim 9 wherein the potting compound is opaque.

14. The method of claim 9 wherein the potting compound is disposed adjacent to and below the strip line coupler, and adjacent to and above the strip line coupler.

* * * * *